US010598418B2

(12) United States Patent
Shen et al.

(10) Patent No.: US 10,598,418 B2
(45) Date of Patent: Mar. 24, 2020

(54) METHOD AND DEVICE FOR CONTROLLING HEAT PUMP

(71) Applicant: UT-Battelle, LLC, Oak Ridge, TN (US)

(72) Inventors: Bo Shen, Oak Ridge, TN (US); Edward Allan Vineyard, Knoxville, TN (US); Omar Abdelaziz, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

(21) Appl. No.: 15/619,010

(22) Filed: Jun. 9, 2017

(65) Prior Publication Data

US 2018/0224176 A1 Aug. 9, 2018

Related U.S. Application Data

(60) Provisional application No. 62/454,931, filed on Feb. 6, 2017.

(51) Int. Cl.
*F25B 13/00* (2006.01)
*F25B 49/02* (2006.01)

(52) U.S. Cl.
CPC ..... *F25B 49/022* (2013.01); *F25B 13/00* (2013.01); *F25B 2313/0293* (2013.01);
(Continued)

(58) Field of Classification Search
CPC ..... F25B 2313/0293; F25B 2400/075; F25B 2600/2513; F25B 2700/2106; F25B 49/022; F25B 13/00
See application file for complete search history.

(56) References Cited

U.S. PATENT DOCUMENTS 5,029,449 A * 7/1991 Wilkinson ..... F24F 1/0003 165/242
5,265,436 A * 11/1993 Murata ..... F25B 13/00 62/175

(Continued)

OTHER PUBLICATIONS

Bertsch, S. S. et al., "Air Source Heat Pump for Northern Climates Part I: Simulation of Different Heat Pump Cycles" International Refrigeration and Air Conditioning Conference at Purdue, pp. 1-8 (2006).

(Continued)

*Primary Examiner* — Filip Zec
(74) *Attorney, Agent, or Firm* — Scully Scott Murphy & Presser, P.C.

(57) ABSTRACT

A method for controlling a heat pump is provided. A working mode of the heat pump is determined. Based on a determination that the working mode of the heat pump is a heating mode, an ambient temperature of the heat pump is determined. Based on a determination that the ambient temperature of the heat pump is higher than a first predetermined temperature, a first compressor of the heat pump is operated. Based on a determination that the ambient temperature of the heat pump is lower than the first predetermined temperature, both the first compressor and a second compressor of the heat pump are enabled to operate, in response to a two-stage thermostat. The first compressor and the second compressor are coupled in parallel. The method allows the heat pump to be suitable for a cold climate.

18 Claims, 6 Drawing Sheets

(52) U.S. Cl.
CPC ..... *F25B 2400/075* (2013.01); *F25B 2400/13* (2013.01); *F25B 2400/23* (2013.01); *F25B 2500/31* (2013.01); *F25B 2600/0251* (2013.01); *F25B 2600/2513* (2013.01); *F25B 2700/2106* (2013.01)

(56) References Cited

U.S. PATENT DOCUMENTS 5,687,579 A * 11/1997 Vaynberg ..... F25B 7/00 62/175
6,044,655 A * 4/2000 Ozaki ..... F25B 9/008 62/205
6,701,732 B2 * 3/2004 Shimoda ..... F25B 13/00 62/228.3
9,335,071 B2 * 5/2016 Kinoshita ..... F24F 11/70

OTHER PUBLICATIONS

Bertsch, S. S. et al., "Two-stage air-source heat pump for residential heating and cooling applications in northern U.S. climates" International Journal of Refrigeration 31:1282-1292 (2008).
Shen, B., et al. "Cold Climate Heat Pumps Using Tandem Compressors" Conference Paper in 2016 ASHRAE Winter Conference.

* cited by examiner

METHOD AND DEVICE FOR CONTROLLING HEAT PUMP

CROSS REFERENCE TO RELATED APPLICATION

The present application claims benefit of United States Provisional Application No. 62/454,931, filed on Feb. 6, 2017, all of the contents of which are incorporated herein by reference.

STATEMENT REGARDING FEDERALLY SPONSORED RESEARCH

This invention was made with government support under Prime Contract No. DE-AC05-00OR22725 awarded by the U.S. Department of Energy. The government has certain rights in the invention.

BACKGROUND

The present disclosure and embodiments thereof are in the field of environmental climate control. More particularly, the present disclosure relates to a method and device for controlling air-source heat pumps (ASHP) to heat residential or commercial premises in cold climate.

Air-source heat pumps have been widely used to heat residential or commercial premises for years. Air-source heat pumps are typically considered economic and environment friendly, because by operation of the air-source heat pumps, heat is extracted from ambient air rather than from burning fossil fuel. As a result, the application of air-source heat pumps for heating residential or commercial premises has become popular and, in some circumstances, mandatory.

However, conventional air-source heat pumps experience poor performance in cold climate. Particularly, as the ambient temperature (or outdoor temperature) of the premises decreases in cold climate regions, the heating capacity and the efficiency of the conventional air-source heat pumps decrease significantly. At the same time, due to the low ambient temperature, the heating demand for the premises increases significantly. When the ambient temperature is below certain critical values (for example, <0° F.), the compressors of most air-source heat pumps fail to work properly. Consequently, supplemental heat sources (typically, electric resistance) are needed, which decreases the heating seasonal performance factor (HSPF) of the air-source heat pumps.

Accordingly, there exists a need in the art to at least overcome the deficiencies and limitations described hereinabove with respect to the conventional air-source heat pumps.

SUMMARY

In one aspect of the present application, a method for controlling a heat pump is provided. The method includes determining a working mode of the heat pump. The working mode is selected from a group consisting of a cooling mode, a defrosting mode and a heating mode. Based on a determination that the working mode of the heat pump is a cooling mode, a first compressor of the heat pump is operated. The method further includes, based on a determination that the working mode of the heat pump is a heating mode, determining an ambient temperature of the heat pump. Based on a determination that the ambient temperature of the heat pump is higher than a first predetermined temperature, the first compressor of the heat pump is operated. Based on a determination that the ambient temperature of the heat pump is lower than the first predetermined temperature, both the first compressor and a second compressor of the heat pump are operated. The first compressor and the second compressor are coupled in parallel.

In another aspect of the present application, a device for controlling a heat pump is provided. The device includes a processor including hardware. The device further includes a memory for storing instructions executable by the processor. The instructions, when executed by the processor, cause the processor to determine a working mode of the heat pump, wherein the working mode is selected from a group consisting of a cooling mode, a defrosting mode and a heating mode; based on a determination that the working mode of the heat pump is a cooling mode, operate a first compressor of the heat pump; based on a determination that the working mode of the heat pump is a heating mode, determine an ambient temperature of the heat pump; based on a determination that the ambient temperature of the heat pump is higher than a first predetermined temperature, operate the first compressor of the heat pump; and based on a determination that the ambient temperature of the heat pump is lower than the first predetermined temperature, operate the first compressor and a second compressor of the heat pump, wherein the first compressor and the second compressor are coupled in parallel.

In yet another aspect of the present application, a non-transitory computer-readable storage medium is provided. The non-transitory computer-readable storage medium stories instructions which, when executed by a processor having hardware, cause the processor to perform a method for controlling a heat pump. The method includes determining a working mode of the heat pump, wherein the working mode is selected from a group consisting of a cooling mode, a defrosting mode and a heating mode; based on a determination that the working mode of the heat pump is a cooling mode, operating a first compressor of the heat pump; based on a determination that the working mode of the heat pump is a heating mode, determining an ambient temperature of the heat pump; based on a determination that the ambient temperature of the heat pump is higher than a first predetermined temperature, operating the first compressor of the heat pump; and based on a determination that the ambient temperature of the heat pump is lower than the first predetermined temperature, operating the first compressor and a second compressor of the heat pump, wherein the first compressor and the second compressor are coupled in parallel.

DETAILED DESCRIPTION OF EMBODIMENTS

Figure 1:
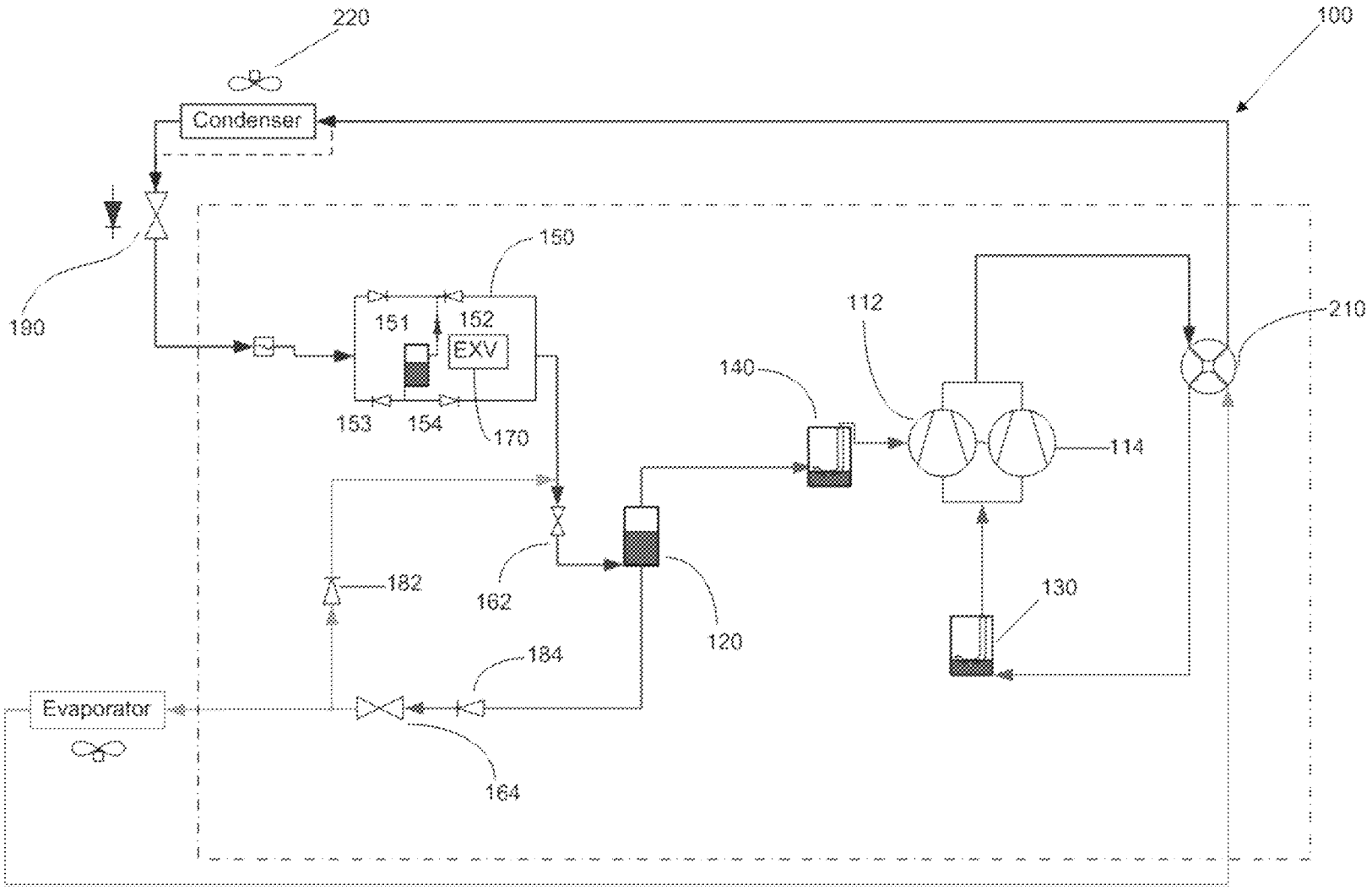
FIG. 1 is a schematic diagram of an air-source heat pump according to an exemplary embodiment of present disclosure.

The present application will now be described in greater detail by referring to the following discussion and drawings that accompany the present application. It is noted that the drawings of the present application are provided for illustrative purposes only and, as such, the drawings are not drawn to scale. It is also noted that like and corresponding elements are referred to by like reference numerals.

Detailed embodiments of the method of the present disclosure are described herein; however, it is to be understood that the disclosed embodiments are merely illustrative of the disclosed method that may be embodied in various forms. In addition, each of the examples given in connection with the various embodiments of the disclosure are intended to be illustrative, and not restrictive. Further, the figures are not necessarily to scale, some features may be exaggerated to show details of particular components.

FIG. 1 is a schematic view of an air-source heat pump 100, according to an exemplary embodiment of the present disclosure. The air-source heat pump 100 has an improved construction, which allows the air-source heat pump to be suitable for efficient operations in cold climates. The air-source heat pump 100 has at least three working modes, i.e., a heating mode, a cooling mode and a defrosting mode. The air-source heat pump 100 includes at least a first compressor 112 and a second compressor 114. The first compressor 112 and the second compressor 114 are coupled to each other in parallel. The first compressor 112 and the second compressor 114 can be identical. For example, both the first compressor 112 and the second compressor 114 can be a vapor injection (VI) scroll compressor. The VI scroll compressors are coupled in parallel to share a same vapor injection port and a same discharge port. Compared with non-VI compressors, vapor injection scroll compressors are less prone to capacity degradation caused by relatively lower ambient temperatures and have relatively lower discharge temperatures. The air-source heat pump 100 further includes an inter-stage flash tank 120, which separates phases and feeds saturated vapor to the vapor injection port of the VI compressors 112 and 114.

The air-source heat pump 100 also includes a suction line accumulator 130, an injection line accumulator 140 and a liquid receiver 150. The inter-stage flash tank 120, the suction line accumulator 130, the injection line accumulator 140 and the liquid receiver 150 together provide charge buffers for the air-source heat pump 100. The liquid receiver 150 is provided with a first one-way check valve 151, a second one-way check valve 152, a third one-way check valve 153 and a fourth one-way check valve 154, for maintaining a common inlet and a common outlet of the liquid receiver 150 when the air-source heat pump 100 is in different working modes. The suction line accumulator 130 and the injection line accumulator 140 also function to prevent a liquid refrigerant from entering the VI compressors 112 and 114, thereby protecting the VI compressors.

A first fixed orifice 162 is installed upstream of the flash tank 120 and a second fixed orifice 164 is installed downstream of the flash tank 120. The first fixed orifice 162 and the second fixed orifice 164 can provide throttling and control the suction and injection pressures of the compressors 112 and 114, when the air-source heat pump 100 is in the heating mode.

The air-source heat pump 100 includes an electronic expansion valve 170, which is provided upstream of the liquid receiver 150. The electronic expansion valve 170 functions to optimize the injection pressure of the first compressor 112 and/or the second compressor 114, as a function of an ambient temperature of the air-source heat pump 100, an air flow rate of an indoor blower (which will be described later), and a compression stage of the first compressors 112 and/or the second compressor 114.

A first check valve 182 and a second check valve 184 are provided to control the flow direction of the refrigerant for cooling, heating and defrosting modes. A thermostatic expansion valve 190 is provided for cooling mode only. A four-way valve 210 is provided for changing the flow direction of the refrigerant. The air-source heat pump 100 further includes a two-speed indoor blower 220, which operates at a first air flow rate in response to a first signal and a second air flow rate in response to a different second signal. The second air flow rate is greater than the first air flow rate.

Figure 2:
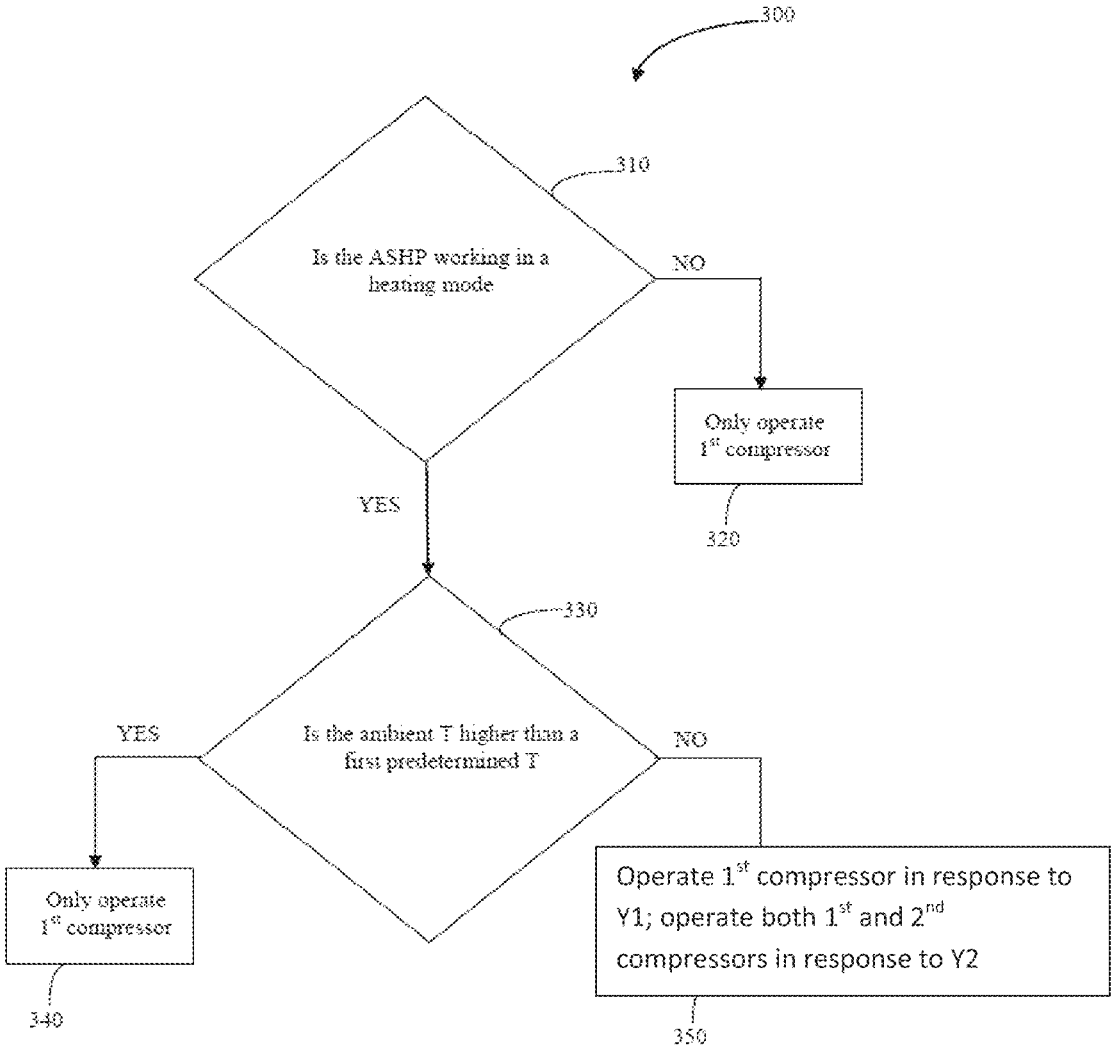
FIG. 2 is a flow diagram of a method for controlling an air-source heat pump according to another exemplary embodiment of present disclosure.

FIG. 2 is a flow diagram showing a method 300 for controlling an air-source heat pump (such as the air-source heat pump 100), according to another embodiment of the present disclosure. The method 300 allows the air-source heat pump 100 to work in an extensive range of operation conditions with optimized efficiency and comfort level and thus, suitable for a cold climate.

At step 310, a working mode of the air-source heat pump 100 is determined. The working mode of the air-source heat pump 100 is typically selected from a group consisting of a heating mode, a cooling mode and a defrosting mode. If it is determined that the working mode of the air-source heat pump 100 is not a heating mode (such as, a cooling mode), only the first compressor 112 is operated at step 320. If it is determined that the working mode of the air-source heat pump 100 is a heating mode, the temperature of the ambient air is determined at step 330. If it is determined that the temperature of the ambient air is higher than a first predetermined temperature, only the first compressor 112 is operated at step 340. The first predetermined temperature can be in a range of 15° F.-25° F., such as, 20° F. Alternatively, the first predetermined temperature can be a proper value set by a user depending on the circumstances. If it is determined that the temperature of the ambient air is lower than the first predetermined temperature, both the first compressor 112 and the second compressor 114 are enabled to operate at step 350. The enabling of the first compressor 112 and the second compressor 114 can be in response to a two-stage thermostat that will be described later. At step 350, when the two-stage thermostat transmits a high stage operation signal, both the first compressor 112 and the second compressor 114 are enabled to operate; when the two-stage thermostat transits a low stage operation signal, only the first compressor 112 is enabled to operate. According to this embodiment, only one compressor is operated at a moderate ambient temperature and two compressors are enabled to operate when the temperature of the ambient air is below a certain point, which prevents running the two compressors unnecessarily when the heating load of a premise is not large. When both the first compressor 112 and the second compressor 114 are operated simultaneously, the fluid refrigerant can be compressed to achieve a relatively higher temperature and pressure. When only the first compressor 112 is operated, the efficiency of the air-source heat pump 100 is realized by bypassing the second compressor 114, when the ambient air temperature is moderately warm. The first compressor 112 and the second compressor 114 are functionally exchangeable. Thus, the first compressor 112 can be bypassed to allow only the second compressor 114 to operate, if necessary.

Figure 3:
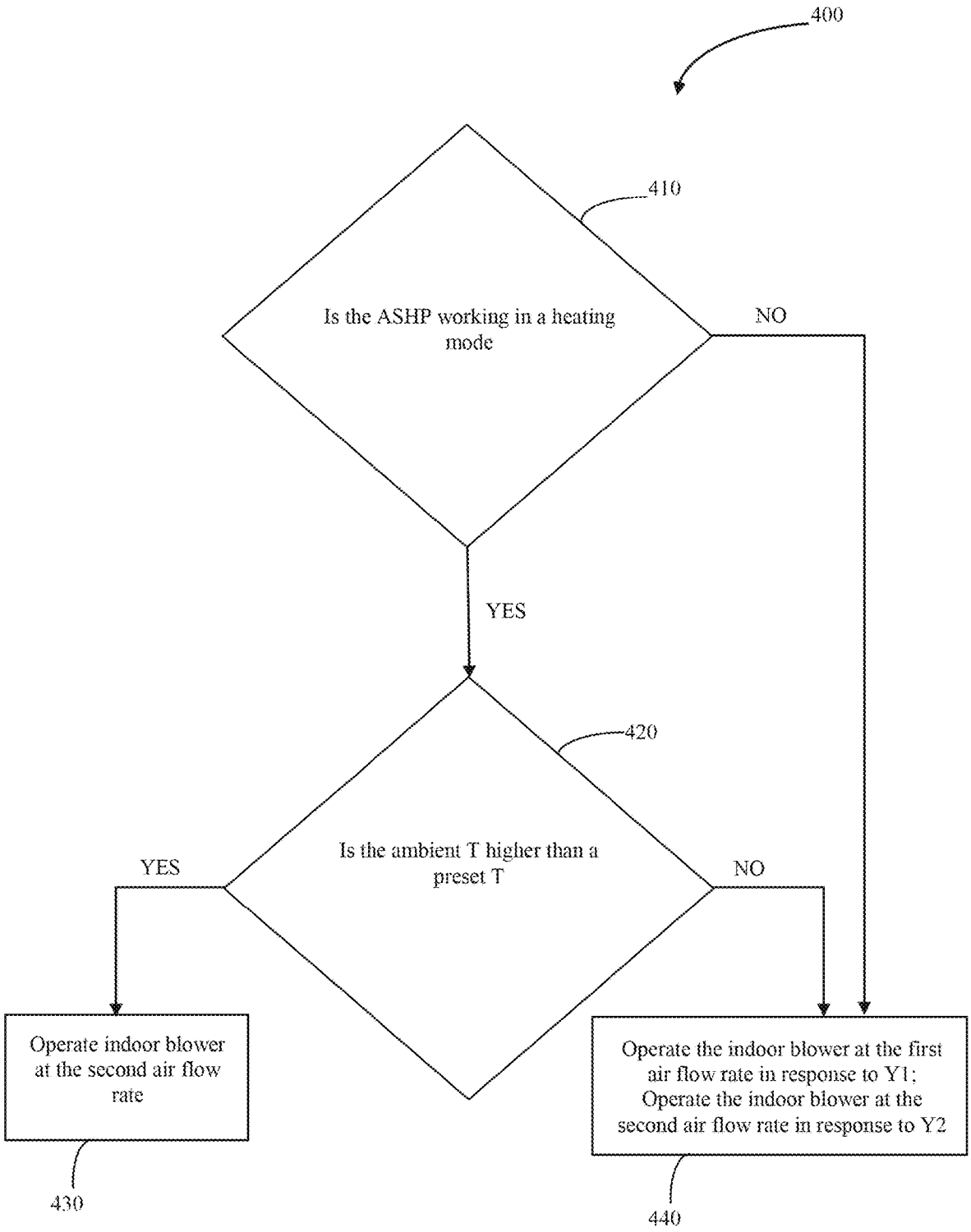
FIG. 3 is a flow diagram of a method for controlling an air-source heat pump according to another exemplary embodiment of present disclosure.

The air-source heat pump 100 can be controlled with a two-stage thermostat, which transmits a first signal Y1 for a low stage operation and a second signal Y2 for a high stage operation. Both signals can be a 24 V signal. Upon receiving the first signal Y1, the indoor blower 220 is operated at a first air flow rate. Upon receiving the second signal Y2, the indoor blower 220 is operated at a second air flow rate that is greater than the first air flow rate. FIG. 3 is a flow diagram showing a method 400 for controlling an air-source heat pump (such as the air-source heat pump 100), according to another embodiment of the present disclosure. According to this method, the indoor blower 220 can be controlled to further enhance the efficiency of the air-source heat pump 100 while maintaining a satisfactory comfort level. At step 410, the working mode of the air-source heat pump 100 is determined. If it is determined that the working mode of the air-source heat pump 100 is the heating mode, the ambient temperature is determined at step 420. If it is determined that the ambient temperature is higher than a preset temperature (such as, a factory preset temperature of 42° F.), the indoor blower 220 is always operated at the second air flow rate (the higher air flow rate), whenever there is a heating request, at step 430. As a result, the temperature of the air supplied to the compressor(s) and the pressure of the air provided to the inlet of the compressor(s) can be reduce at moderate ambient temperatures, which in turn enhances the efficiency of the air-source heat pump 100. If it is determined that the ambient temperature is not higher than the preset temperature, the indoor blower 220 operates at the first air flow rate (the lower air flow rate) in response to the Y1 signal and at the second air flow rate (the higher air flow rate) in response to the Y2 signal, at step 440. If it is determined that the working mode of the air-source heat pump 100 is not the heating mode, step 440 is implemented.

Figure 4:
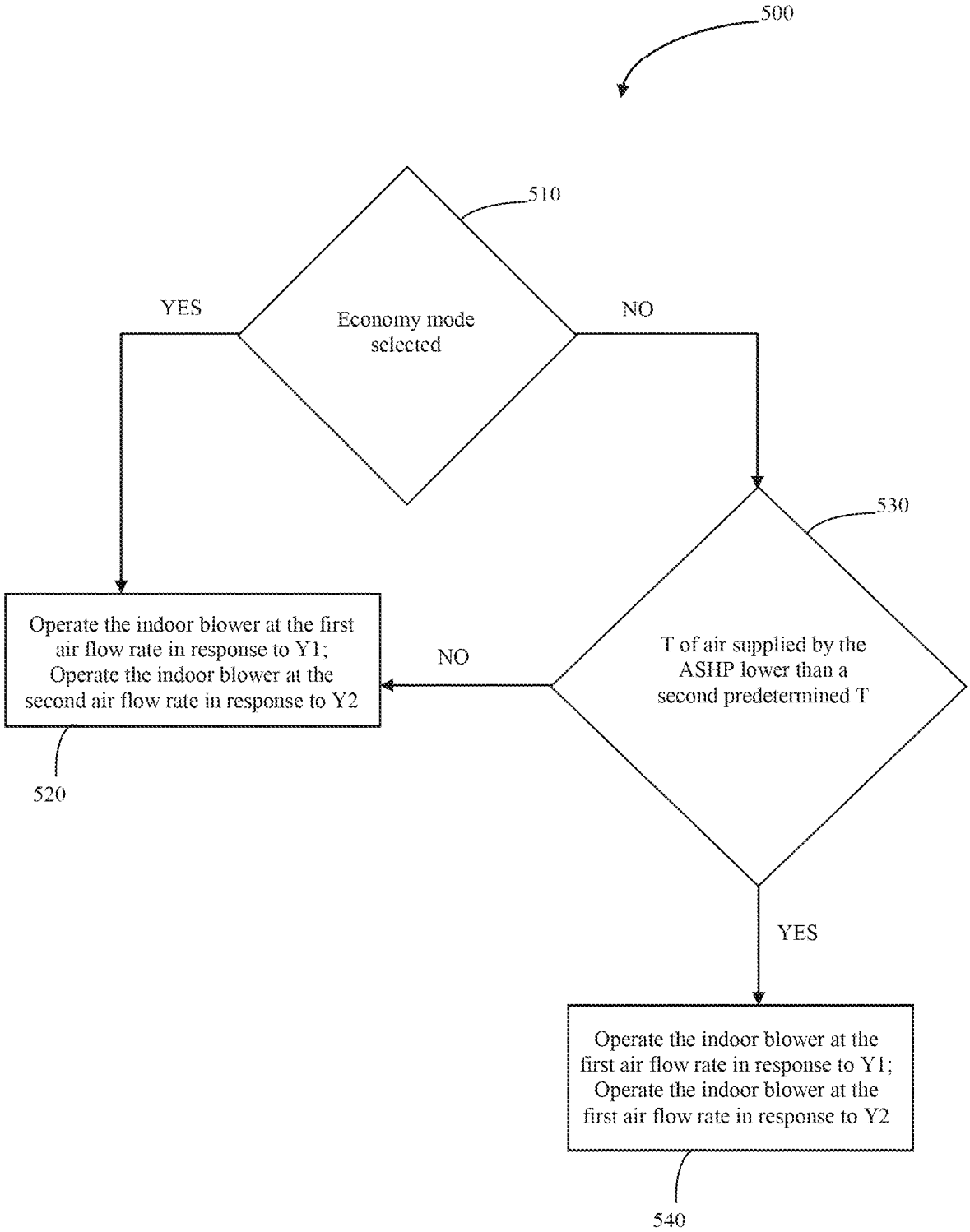
FIG. 4 is a flow diagram of a method for controlling an air-source heat pump according to another exemplary embodiment of present disclosure.

FIG. 4 is a flow diagram showing a method 500 for controlling an air-source heat pump (such as the air-source heat pump 100), according to another embodiment of the present disclosure. According to this method, two control modes (i.e., an economy mode and a comfort mode) are provided to enhance the efficiency and comfort level of the air-source heat pump 100. At step 510, it is determined whether the economy mode or the comfort mode has been selected. When it is determined that the air-source heat pump 100 is operated at the economy mode, the indoor blower 220 operates at the first air flow rate in response to the Y1 signal and at the second air flow rate in response to the Y2 signal, at step 520. The working stages of the indoor blower 220 match the working stages of the compressor(s). When it is determined that the air-source heat pump 100 is operated at the comfort mode, the temperature of air supplied by the air-source heat pump 100 is determined, at step 530. When it is determined that the temperature of the air supplied by the air-source heat pump 100 is lower than a second predetermined temperature, the indoor blower 220 operates at the first air flow rate in response to both the Y1 signal and the Y2 signal, at step 540. The second predetermined temperature typically ranges from 90° F. to 100° F., and can be 95° F.

According to still another aspect of this embodiment, a method 600 is provided, in which the operation of the electronic expansion valve 170 of the air-source heat pump 100 is controlled to adjust the operation of at least one of the first compressor 112 and the second compressor 114 in an optimal manner, by optimizing the injection pressure of the first compressor 112 and/or the second compressor 114. The opening of the electronic expansion valve 170 is controlled based on an ambient temperature, a current air flow rate of the indoor blower 220, and an operating stage of the first compressor 112 and/or an operating stage of the second compressor 114.

For example, when both the first compressor 112 and the second compressor 114 are being operated simultaneously in a parallel manner, the opening of the electronic expansion valve 170 can be controlled to adjust an inter-stage pressure of the first compressor 112 and the second compressor 114. Moreover, the opening of the electronic expansion valve 170 can be controlled to further adjust the pressure ratio of a first stage compression of both the first compressor 112 and the second compressor 114 with respect to a second stage compression of both the first compressor 112 and the second compressor 114. The first stage compression is upstream of the second stage compression. The first stage compression can be a compression operation from the inlet of the compressors to an inter-stage of the compressors and the second stage compression can be a compression operation from the inter-stage to the outlet of the compressors. When the temperatures of the ambient air vary in a wide range, the plurality of pressure ratios can be adjusted to be substantially equal to one another. The above-described operation achieved by controlling the opening of the electronic expansion valve 170 is equally applicable, when only one of the compressors is being operated.

Figure 5:
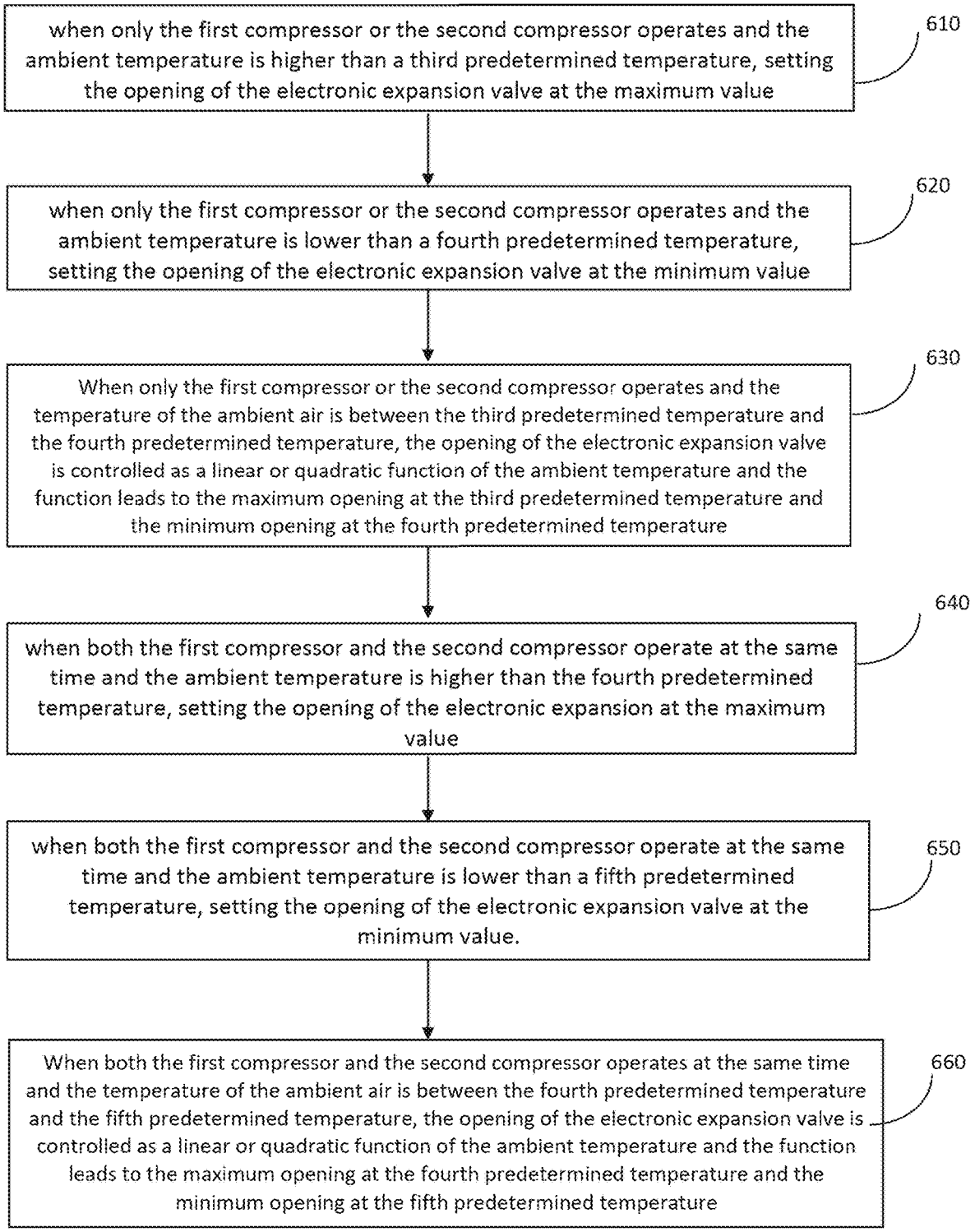
FIG. 5 is a flow diagram of a method for controlling an air-source heat pump according to another exemplary embodiment of present disclosure.

FIG. 5 is a flow diagram showing a method 600 for controlling an air-source heat pump (such as the air-source heat pump 100), according to another embodiment of the present disclosure. According to this method, the opening of the electronic expansion valve 170 is controlled to further improve the efficiency of the air-source heat pump. The opening of the electronic expansion valve 170 has a range defined between a minimum value (such as, 20% to 30% opening of the electronic expansion valve) and a maximum value (such as, 100% opening of the electronic expansion valve). At step 610, when it is determined that only the first compressor 112 or the second compressor 114 is being operated and that the temperature of the ambient air is higher than a third predetermined temperature, the opening of the electronic expansion valve 170 is set at the maximum value. The third predetermined temperature can be in a range of 40° F. to 50° F., such as, 47° F. At step 620, when it is determined that only the first compressor 112 or the second compressor 114 is being operated and that the temperature of the ambient air is lower than a fourth predetermined temperature, the opening of the electronic expansion valve 170 is set at the minimum value. The fourth predetermined temperature can be in a range of 10° F. to 20° F., such as, 17° F. When it is determined that only the first compressor 112 or the second compressor 114 is being operated and that the temperature of the ambient air is between the third predetermined temperature and the fourth predetermined temperature, the opening of the electronic expansion valve is controlled as a linear or quadratic function of the ambient temperature and the function leads to the maximum opening of the electronic expansion valve 170 at the third predetermined temperature and the minimum opening at the fourth predetermined temperature, at step 630. At step 640, when it is determined that both the first compressor 112 and the second compressor 114 are being operated at the same time and that the temperature of the ambient air is higher than the fourth predetermined temperature, the opening of the electronic expansion valve 170 is set at the maximum value. At step 650, when it is determined that both the first compressor 112 and the second compressor 114 are being operated at the same time and that the temperature of the ambient air is lower than a fifth predetermined temperature, the electronic expansion valve is set at the minimum value. The fifth predetermined temperature is lower than the fourth predetermined temperature. The fifth predetermined temperature can be in a range of minus 20° F. to minis 10° F., such as, minus 13° F. When it is determined that both the first compressor 112 and the second compressor 114 are being operated at the same time and that the temperature of the ambient air is between the fourth predetermined temperature and the fifth predetermined temperature, the opening of the electronic expansion valve is controlled as a linear or quadratic function of the ambient temperature and the function leads to the maximum opening at the fourth predetermined temperature and the minimum opening at the fifth predetermined temperature, at step 660.

The dimension of first fixed orifice 162 and/or the dimension of the second fixed orifice 164 can be adjusted manually by a field technician for maintenance. The properly dimensioned orifices 162 and 164, the controlling of the opening of the electronic expansion valve 170, and the provision of the flash tank 120, in conjunction, allow the first compressor 112 and the second compressor 114 to work in a wide range of ambient temperatures and prevent undesirable overfeeding or underfeeding of vapor into the compressors. In addition, the controlling of the opening of the electronic expansion valve 170 also improves the migration of the refrigerant flow between the flash tank 120, the liquid receiver 150, the injection line accumulator 140 and the suction line accumulator 130.

The methods 300-600, as described above, can be implemented independently or inter-dependently. For example, the method 400 for controlling the air flow rate of the indoor blower 220 is implementable in conjunction with the method 300 for selectively controlling the operation of the compressors 112 and 114. The method 500 for selecting an economic mode or comfort mode is also implementable in conjunction with the method 300 and/or the method 400. The method 600 for controlling the opening of the electronic expansion valve 170 is also implementable in conjunction with the method 300, the method 400 and/or the method 500.

Figure 6:
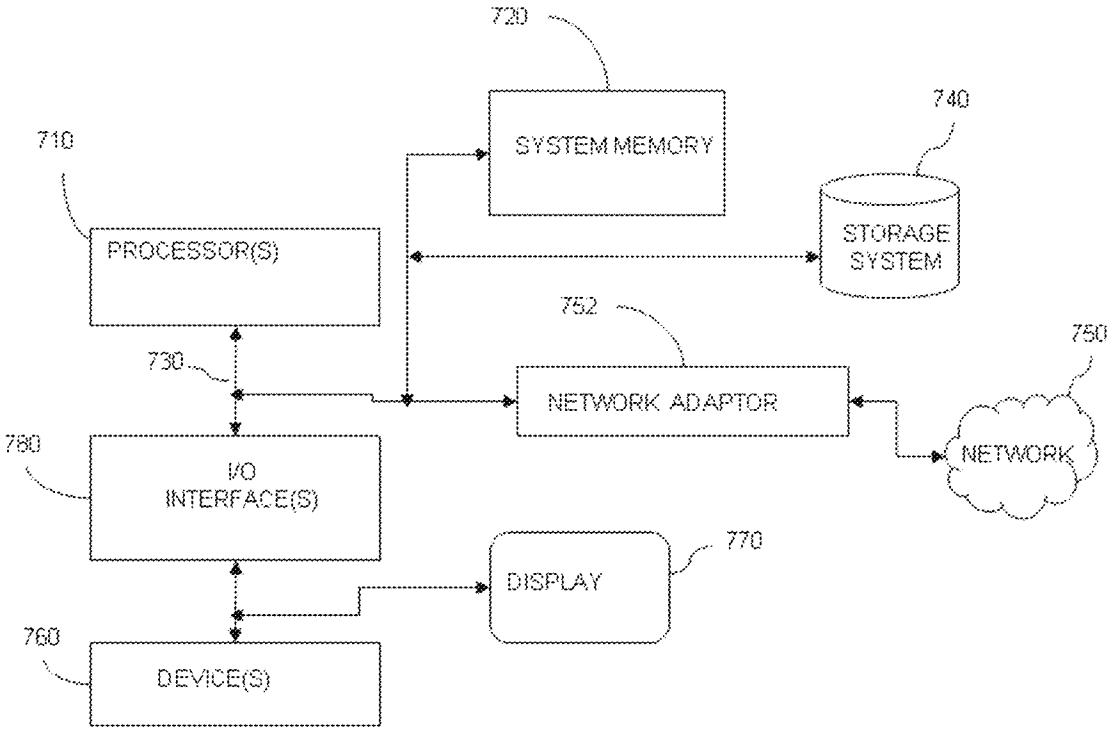
FIG. 6 is a schematic diagram of a device for controlling an air-source heat pump according to another exemplary embodiment of present disclosure.

According to another aspect of the present disclosure, a device 700 is provided, which is shown in FIG. 6. The device is configured and programmed to control an air-source heat pump (such as, the air-source heat pump 100) to render the heat pump to be suitable for a cold climate. The device 700 can be a computer system, which may be operational with numerous other general purpose or special purpose computing system environments or configurations. Examples of known computing systems, environments, or configurations that may be suitable for use with the computer system shown in FIG. 6 may include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

The components of the device 700 may include, but are not limited to, at least one processor 710 that comprises hardware, a system memory 720, and a bus 730 that couples various system components including system memory 720 to processor 710. The system memory 720 is configured to store instructions, which when be executed by the processor 710, cause the processor to implement the methods 300-600 as described above. The instructions can be loaded from one or more storage systems 740, one or more networks 750 or the combinations thereof.

The bus 730 can represent one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

The device can include a variety of computer system readable media. Such media may be any available media that is accessible by computer system, and it may include both volatile and non-volatile media, removable and non-removable media.

The system memory 730 can include computer readable media in the form of volatile memory, such as random access memory (RAM) and/or cache memory or others. The device can further include other removable/non-removable, volatile/non-volatile computer system storage media. By way of example only, the storage system 740 can be provided for reading from and writing to a non-removable, non-volatile magnetic media (e.g., a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to the bus 730 by one or more data media interfaces.

The device can also communicate with one or more external devices 760, such as a keyboard, a pointing device, a display 770, etc.; one or more devices that enable a user to interact with the device; and/or any devices (e.g., network card, modem, etc.) that enable the device to communicate with one or more other computing devices. Such communication can occur via Input/Output (I/O) interfaces 780.

The device 700 can communicate with the one or more networks 750, such as a local area network (LAN), a general wide area network (WAN), and/or a public network (e.g., the Internet) via a network adapter 752. As depicted, the network adapter 752 communicates with the other components of the device via the bus 730. It should be understood that although not shown, other hardware and/or software components could be used in conjunction with computer system. Examples include, but are not limited to: microcode, device drivers, redundant processing units, external disk drive arrays, RAID systems, tape drives, and data archival storage systems, etc.

Another aspect of the present disclosure is directed to a computer program product. The computer program product may include a computer readable storage medium (or media) having computer readable program instructions thereon for causing a processor to carry out the methods of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

The computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

The computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

A prototype cold climate heat pump, according to the above-described embodiments, has been built and tested in environmental chambers. According to the test, a heating capacity of more than 90% can be achieved relative to the rated capacity of the heat pump. When the ambient temperature is about −13° F., a coefficient of performance (COP) of about 2.0 can be achieved. When the ambient temperature is about 47° F., a COP greater than 4.5 can be achieved. A heating seasonal performance factor (HSPF) greater than 11.0 can be achieved. The prototype has been field tested in Fairbanks, Ak. During the field test, the cold climate heat pump can successfully operate at an ambient temperature of minus 30° F. (minus 35° C.), with a heating capacity of more than 75% and a COP of more than 1.8.

The technological improvements according to the present disclosure potentially benefit a substantial portion of the U.S. population, especially with more than one-third of U.S. housing stock concentrated in cold regions of the country and another 31% in the mixed-humid climate region. Approximately 2.6 million U.S. homes in the cold climate northern regions of the U.S. use electric furnaces or conventional air-source heat pumps. Over 45 million homes using gas, propane, or oil furnaces across both the cold/very cold and mixed-humid regions and homes using electric furnaces in the mixed-humid regions can also benefit from the technological improvements according to the present disclosure. Results show that high performance cold climate heat pumps provide significant energy savings over existing technologies, as high as 70% compared with an electric furnace. Within an estimated cold climate heat pump penetration rate ranging from 5% to 35% in these regions, annual primary energy savings of 0.05 quad and $CO_2$ emissions reduction of 0.47 million metric tons can be achieved by the year 2030.

While the present application has been particularly shown and described with respect to various embodiments thereof, it will be understood by those skilled in the art that the foregoing and other changes in forms and details may be made without departing from the spirit and scope of the present application. It is therefore intended that the present application not be limited to the exact forms and details described and illustrated, but fall within the scope of the appended claims.

What is claimed is:

1. A method for controlling a heat pump, comprising:

determining a working mode of the heat pump, wherein the working mode is selected from a group consisting of a cooling mode, a defrosting mode and a heating mode;

based on a determination that the working mode of the heat pump is a heating mode, determining an ambient temperature of the heat pump;

based on a determination that the ambient temperature of the heat pump is higher than a first predetermined temperature, operating a first compressor of the heat pump;

based on a determination that the ambient temperature of the heat pump is lower than the first predetermined temperature, operating the first compressor and a second compressor of the heat pump, wherein the first compressor and the second compressor are coupled in parallel; and controlling an opening of an electronic expansion valve of the heat pump to adjust the operation of at least one of the first compressor and the second compressor by adjusting:

an inter-stage pressure of the at least one of the first compressor and the second compressor, and a plurality of pressure ratios of a first stage compression relative to a second stage compression of the at least one of the first compressor and the second compressor in response to a plurality of ambient temperatures, respectively, wherein the first stage compression is upstream of the second compression stage and the plurality of pressure ratios are substantially equal to each other.

2. The method according to claim 1, wherein the first compressor comprises a first vapor injection scroll compressor and the second compressor comprises a second vapor injection scroll compressor.

3. The method according to claim 1, wherein the first predetermined temperature is 20° F., which is settable by a user as a default value.

4. The method according to claim 1, further comprising:

operating an indoor blower of the heat pump to work at a first air flow rate in response to a first signal provided by a user of the heat pump; and operating the indoor blower of the heat pump to work at a second air flow rate in response to a second signal provided by the user, wherein the second air flow rate greater than the first air flow rate and the second signal is different from the first signal.

5. The method according to claim 1, further comprising:

determining an air temperature of air supplied by the heat pump; and based on a determination that the air temperature of the air supplied by the heat pump is lower than a second predetermined temperature, operating an indoor blower of the heat pump, wherein the indoor blower has a first air flow rate and a second air flow rate that is greater than the first air flow rate, wherein operating the indoor blower comprises:

operating the indoor blower of the heat pump to work at the first air flow rate in response to a first signal provided by a user of the heat pump; and operating the indoor blower of the heat pump to work at the first air flow rate in response to a second signal provided by the user, wherein the second signal is different from the first signal.

6. The method according to claim 1, wherein the opening of the electronic expansion valve is controlled based on the ambient temperature, an air flow rate of an indoor blower of the heat pump, and at least one of an operating stage of the first compressor and an operating stage of the second compressor.

7. A device for controlling a heat pump, comprising:

a processor comprising hardware; and a memory for storing instructions executable by the processor, wherein the instructions, when executed by the processor, cause the processor to:

determine a working mode of the heat pump, wherein the working mode is selected from a group consisting of a cooling mode, a defrosting mode and a heating mode;

based on a determination that the working mode of the heat pump is a heating mode, determine an ambient temperature of the heat pump;

based on a determination that the ambient temperature of the heat pump is higher than a first predetermined temperature, operate a first compressor of the heat pump;

based on a determination that the ambient temperature of the heat pump is lower than the first predetermined temperature, operate the first compressor and a second compressor of the heat pump, wherein the first compressor and the second compressor are coupled in parallel; and control an opening of an electronic expansion valve of the heat pump to adjust the operation of at least one of the first compressor and the second compressor by adjusting:

an inter-stage pressure of the at least one of the first compressor and the second compressor, and a plurality of pressure ratios of a first stage compression relative to a second stage compression of the at least one of the first compressor and the second compressor in response to a plurality of ambient temperatures, respectively, wherein the first stage compression is upstream of the second compression stage and the plurality of pressure ratios are substantially equal to each other.

8. The device according to claim 7, wherein the first predetermined temperature is 20° F., which is settable by a user as a default value.

9. The device according to claim 7, wherein the instructions, when executed by the processor, further cause the processor to:

operate an indoor blower of the heat pump to work at a first air flow rate in response to a first signal provided by a user of the heat pump; and operate the indoor blower of the heat pump to work at a second air flow rate in response to a second signal provided by the user, wherein the second air flow rate is greater than the first air flow rate and the second signal is different from the first signal.

10. The device according to claim 7, wherein the instructions, when executed by the processor, further cause the processor to:

determine an air temperature of air supplied by the heat pump; and based on a determination that the air temperature of the air supplied by the heat pump is lower than a second predetermined temperature, operate an indoor blower of the heat pump, wherein the indoor blower has a first air flow rate and a second air flow rate that is greater than the first air flow rate, wherein the instructions, when executed by the processor, further cause the processor to operate the indoor blower comprises the instructions, when executed by the processor, cause the processor to:

operate the indoor blower of the heat pump to work at the first air flow rate in response to a first signal provided by a user of the heat pump; and operate the indoor blower of the heat pump to work at the first air flow rate in response to a second signal provided by the user, wherein the second signal is different from the first signal.

11. The device according to claim 7, wherein the opening of the electronic expansion valve is controlled based on the ambient temperature, an air flow rate of an indoor blower of the heat pump, and at least one of an operating stage of the first compressor and an operating stage of the second compressor.

12. A device for controlling a heat pump, comprising:

a processor comprising hardware; and a memory for storing instructions executable by the processor, wherein the instructions, when executed by the processor, cause the processor to:

determine a working mode of the heat pump, wherein the working mode is selected from a group consisting of a cooling mode, a defrosting mode and a heating mode;

based on a determination that the working mode of the heat pump is a heating mode, determine an ambient temperature of the heat pump;

based on a determination that the ambient temperature of the heat pump is higher than a first predetermined temperature, operate a first compressor of the heat pump;

based on a determination that the ambient temperature of the heat pump is lower than the first predetermined temperature, operate the first compressor and a second compressor of the heat pump, wherein the first compressor and the second compressor are coupled in parallel; and control an opening of an electronic expansion valve of the heat pump to adjust the operation of at least one of the first compressor and the second compressor, wherein the opening of the electronic expansion valve has a range defined between a minimum value and a maximum value;

wherein the opening of the electronic expansion valve is at the maximum value, based on a determination that only the first compressor is operated and that the ambient temperature is higher than a third predetermined temperature;

wherein the opening of the electronic expansion valve is at the minimum value, based on a determination that only the first compressor is operated and that the ambient temperature is lower than a fourth predetermined temperature; and wherein the opening of the electronic expansion valve is controlled as at least one of a linear or quadratic function of the ambient temperature and the function causes the maximum opening at the third predetermined temperature and the minimum opening at the fourth predetermined temperature, based on a determination that only the first compressor is operated and that the ambient temperature is between the third predetermined temperature and the fourth predetermined temperature.

13. The device according to claim 12, wherein the opening of the electronic expansion valve is at the maximum value, based on a determination that both the first compressor and the second compressor are operated and that the ambient temperature is higher than the fourth predetermined temperature;

wherein the opening of the electronic expansion valve is at the minimum value, based on a determination that both the first compressor and the second compressor are operated and that the ambient temperature is lower than a fifth predetermined temperature; and wherein the opening of the electronic expansion valve is controlled as at least one of a linear or quadratic function of the ambient temperature and the function causes the maximum opening at the fourth predetermined temperature and the minimum opening at the fifth predetermined temperature, based on a determination that both the first compressor and the second compressor are operated and that the ambient temperature is between the fourth predetermined temperature and the fifth predetermined temperature.

14. The device according to claim 13, wherein the third predetermined temperature is in a range from 40° F. to 50° F., the fourth predetermined temperature is in a range of 10° F. to 20° F., and the fifth predetermined temperature is in a range of −20° F. to −10° F.

15. A method for controlling a heat pump, comprising:

determining a working mode of the heat pump, wherein the working mode is selected from a group consisting of a cooling mode, a defrosting mode and a heating mode;

based on a determination that the working mode of the heat pump is a heating mode, determining an ambient temperature of the heat pump;

based on a determination that the ambient temperature of the heat pump is higher than a first predetermined temperature, operating a first compressor of the heat pump;

based on a determination that the ambient temperature of the heat pump is lower than the first predetermined temperature, operating the first compressor and a second compressor of the heat pump, wherein the first compressor and the second compressor are coupled in parallel; and controlling an opening of an electronic expansion valve of the heat pump to adjust the operation of at least one of the first compressor and the second compressor, wherein the opening of the electronic expansion valve has a range defined between a minimum value and a maximum value;

wherein the opening of the electronic expansion valve is at the maximum value, based on a determination that only the first compressor is operated and that the ambient temperature is higher than a third predetermined temperature;

wherein the opening of the electronic expansion valve is at the minimum value, based on a determination that only the first compressor is operated and that the ambient temperature is lower than a fourth predetermined temperature; and wherein the opening of the electronic expansion valve is controlled as at least one of a linear or quadratic function of the ambient temperature and the function causes the maximum opening at the third predetermined temperature and the minimum opening at the fourth predetermined temperature, based on a determination that only the first compressor is operated and that the ambient temperature is between the third predetermined temperature and the fourth predetermined temperature.

16. The method according to claim 15, wherein the opening of the electronic expansion valve is at the maximum value, based on a determination that both the first compressor and the second compressor are operated and that the ambient temperature is higher than the fourth predetermined temperature;

wherein the opening of the electronic expansion valve is at the minimum value, based on a determination that both the first compressor and the second compressor are operated and that the ambient temperature is lower than a fifth predetermined temperature; and wherein the opening of the electronic expansion valve is controlled as at least one of a linear or quadratic function of the ambient temperature and the function causes the maximum opening at the fourth predetermined temperature and the minimum opening at the fifth predetermined temperature, based on a determination that both the first compressor and the second compressor are operated and that the ambient temperature is between the fourth predetermined temperature and the fifth predetermined temperature.

17. The method according to claim 16, wherein the third predetermined temperature is in a range from 40° F. to 50° F., the fourth predetermined temperature is in a range of 10° F. to 20° F., and the fifth predetermined temperature is in a range of −20° F. to −10° F.

18. A non-transitory computer-readable storage medium storing instructions which, when executed by a processor having hardware, cause the processor to perform a method for controlling a heat pump, the method comprising:

determining a working mode of the heat pump, wherein the working mode is selected from a group consisting of a cooling mode, a defrosting mode and a heating mode;

based on a determination that the working mode of the heat pump is a heating mode, determining an ambient temperature of the heat pump;

based on a determination that the ambient temperature of the heat pump is higher than a first predetermined temperature, operating a first compressor of the heat pump;

based on a determination that the ambient temperature of the heat pump is lower than the first predetermined temperature, operating the first compressor and a second compressor of the heat pump, wherein the first compressor and the second compressor are coupled in parallel; and controlling an opening of an electronic expansion valve of the heat pump to adjust the operation of at least one of the first compressor and the second compressor by adjusting:

an inter-stage pressure of the at least one of the first compressor and the second compressor, and a plurality of pressure ratios of a first stage compression relative to a second stage compression of the at least one of the first compressor and the second compressor in response to a plurality of ambient temperatures, respectively, wherein the first stage compression is upstream of the second compression stage and the plurality of pressure ratios are substantially equal to each other.

* * * * *